US005997820A

United States Patent [19]

MacDonald

[11] Patent Number: 5,997,820

[45] Date of Patent: Dec. 7, 1999

[54] INTEGRALLY ATTACHED AND OPERABLE MULTIPLE REACTION VESSELS

[75] Inventor: Stuart Gilmour MacDonald, Pultneyville, N.Y.

[73] Assignee: Johnson & Johnson Clinical Diagnostics, Inc., Rochester, N.Y.

[21] Appl. No.: 09/047,098

[22] Filed: Mar. 24, 1998

Related U.S. Application Data

[60] Provisional application No. 60/047,059, May 19, 1997.

[51] Int. Cl.[6] ..... B01L 3/00

[52] U.S. Cl. ..... 422/102; 422/99; 422/103; 215/309

[58] Field of Search ..... 422/99–104; 215/28–30, 215/227–228, 247, 309

[56] References Cited

U.S. PATENT DOCUMENTS

| | | | |
|---|---|---|---|
| 4,198,484 | 4/1980 | Reichler et al. | 422/102 |
| 5,011,663 | 4/1991 | Innocenti | 422/102 |
| 5,089,233 | 2/1992 | DeVaney et al. | 422/99 |
| 5,229,297 | 7/1993 | Schnipelsky et al. | 436/94 |
| 5,436,129 | 7/1995 | Stapleton | 435/6 |

*Primary Examiner*—Lyle A. Alexander

[57] ABSTRACT

A reaction vessel for confined amplification and detection of nucleic acid material. The vessel features a plurality of adjacent chambers, each chamber comprising a front wall, a back wall, two side walls, and a bottom wall, the front and back walls terminating in an upper opening at a top edge of said front and back walls, a side wall of each chamber comprising a side wall in common with an adjacent chamber so as to integrally connect the chambers side-by-side; the front wall of each chamber including a liquid access port spanning all of the chambers below the top edge, the common side walls terminating at the port; and a movable elastomeric plug mounted within the upper opening above the port, shaped to block the port of each of the chambers and to stopper each the chamber when moved below the top edge, the plug spanning across all of the chambers in the vessel so as to close off the port simultaneously for all of the chambers when moved below the top edge.

3 Claims, 1 Drawing Sheet

INTEGRALLY ATTACHED AND OPERABLE MULTIPLE REACTION VESSELS

This Application is a Continuation of and claims the benefit of the filling date of, Provisional Application No. 60/047,059, filed May 19, 1997.

FIELD OF THE INVENTION

This invention relates to a reaction vessel for performing amplification and detection of nucleic acid materials, preferably by homogeneous PCR.

BACKGROUND OF THE INVENTION

It is known to do PCR amplification, and then separation and detection of captured targeted nucleic acid material in a closed container, such containers being individually processed, but in parallel, in a processor. Examples are described in U.S. Pat. No. 5,229,297 for the container, and U.S. Pat. No. 5,089,233 for the processor. These examples are used primarily for heterogeneous PCR, which relies upon amplification and detection done in separate chambers and separate steps. Although such a system is a breakthrough in using PCR for diagnostic purposes, due to the confinement that prevents carryover contamination of yet-to-be used containers, it has a minor drawback: Each container has to be separately loaded with sample and then sealed, and amplified target has to be moved to a separate detection site. In contrast, it is known that homogeneous PCR does not require separate processing of amplification and detection in separate chambers.

There has been a need, therefore, prior to this invention, for a device that permits homogeneous PCR to be done in a plurality of containers that are sample-loaded and then sealed, all at once, together.

SUMMARY OF THE INVENTION

The invention is achieved more specifically as follows:

A reaction vessel for confined amplification and detection of nucleic acid material, comprising:

a plurality of adjacent chambers, each chamber comprising a front wall, a back wall, two side walls, and a bottom wall, the front and back walls terminating in an upper opening at a top edge of each of the front and back walls, a side wall of each chamber comprising a side wall in common with an adjacent chamber so as to integrally connect the chambers side-by-side;

the front wall of each chamber including a liquid access port spanning all of the chambers below the top edge, the common side walls terminating at the port; and a movable elastomeric plug mounted within the upper opening above the port, shaped to block the port of all of the chambers and to stopper all of the chambers when moved below the top edge, the plug spanning across all of the chambers in the vessel so as to close off the port simultaneously for all of the chambers when moved below the top edge.

Thus, it is an advantageous feature of the invention that a reaction vessel is provided that permits homogenous PCR to be done on a plurality of containers all at once, with no movement required between stations once the vessel is closed with all liquids present.

Other advantageous features will become apparent upon reference to the following Description of the Preferred Embodiments, when read in light of the attached drawings.

DESCRIPTION OF THE PREFERRED EMBODIMENTS

The description that follows features a preferred embodiment in which the vessels have a particular shape and are used for homogenous PCR reactions. In addition, the invention is useful regardless of the shape of the vessel and the reactions therein, provided the front wall has a liquid access port as described, that is sealed for all the containers by a common plug.

Such a reaction vessel can be made to be thermally thin, that is, having through at least one of its major wall surfaces, a rapid heat transfer capability producing an exponential time constant on the order of 3–5 seconds, for a fluid volume on the order of 100 $\mu$L. Thus, the thermal time constant for each chamber of the vessel is comparable to that of the cuvette of U.S. Pat. No. 5,229,297, column 8, lines 58–68.

The vessel also has a shape that allows for fluorescence detection, for homogeneous PCR reactions using a DNA probe bearing a fluor marker at one end. Useful probes using such markers are described in, e.g., *Nature Biotechnology*, Volume 14, March 1996, pages 264 and 303–308. When heated, they unwind to a form that can hybridize with a complimentary DNA target strand, producing a double strand that will fluoresce in proportion to the amount of target it is hybridized to. (Such probes are prevented by a quenching molecule from fluorescing if they are not hybridized.)

Figure 1:
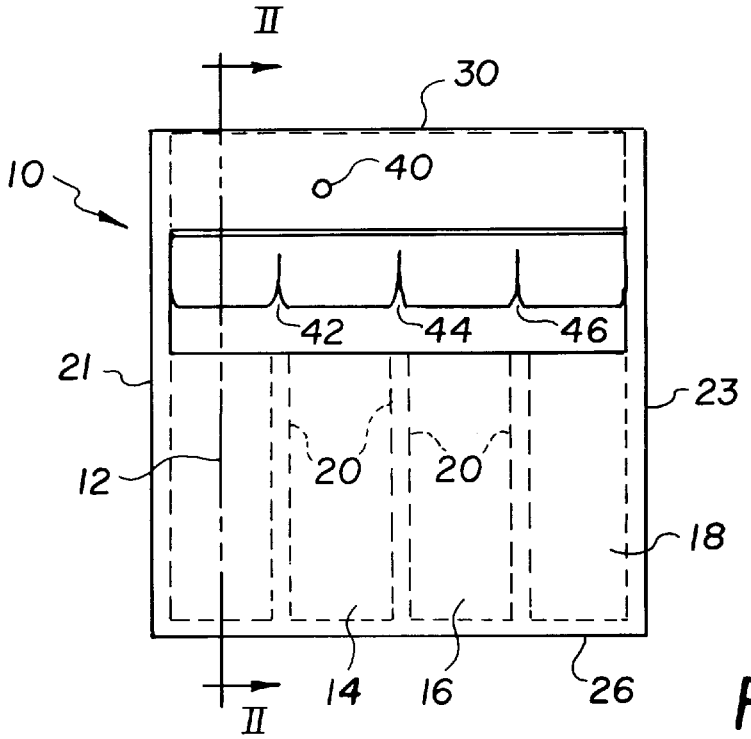
FIG. 1 is a front elevational view of a vessel constructed according to the invention.
Figure 2:
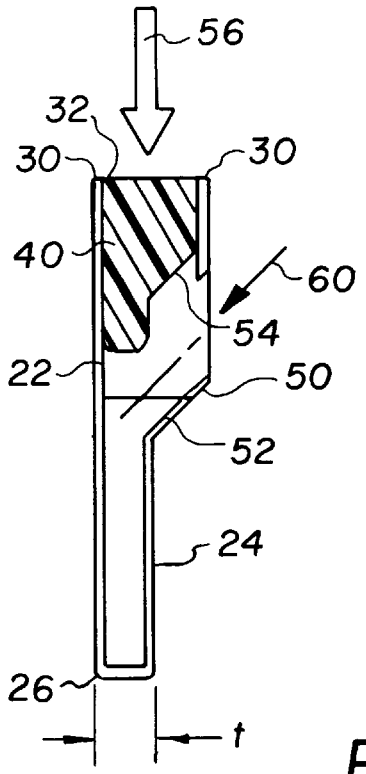
FIG. 2 is a section view taken generally along the line II—II of FIG. 1.

More specifically, FIG. 1, there is provided a vessel 10 formed from a plurality of integrally connected chambers 12,14,16,18, each sharing a common side wall 20 with the adjacent one or two chambers. Side walls 21,23 form the end walls. Each chamber also has a back wall 22, FIG. 2, that is common to all the chambers, along with a common front wall 24 and a bottom wall 26. The top edges 30 of the front and back walls are open to create upper opening 32 which holds a moveable elastomeric plug 40 that extends across all the chambers. Plug 40 is serrated at 42,44,46, FIG. 1, to allow side walls 20 to lock within the plug when the plug is moved as described below. The walls of chambers 12,14, 16,18 are preferably transparent plastic of about 0.02 inch thickness.

Front wall 24 has a liquid access opening 50 that extends across all the chambers, to allow sample liquid to be injected. Front wall 24 is also stepped down at shoulder 52 to reduce the thickness "t" of the bottom portions of each chamber. Shoulder 52 is also effective to seal against surface 54 of plug 40 when the latter is moved down, arrow 56, FIG. 2.

Any rigid plastic transparent to the fluorescent signal, can be used for the vessel, such as polystyrene, acrylic, or polycarbonate.

Referring to each of the chambers, each chamber contains, along with PCR amplifying reagents, a detection reagent or reagents specific to a particular assay unique to that chamber. Patient sample DNA is injected through opening 50, arrow 60 into all of the chambers, so that each has about 100 $\mu$l of fluid, and plug 40 is moved down, arrow 56, to seal off opening 50 as well as each chamber's connection to the other chambers. Amplification is then achieved by heating and cooling as dictated by the well-known PCR process, until sufficient target DNA is produced to produce a detectable fluorescent signal.

The invention disclosed herein may be practiced in the absence of any element which is not specifically disclosed herein.

The invention has been described in detail with particular reference to preferred embodiments thereof, but it will be understood that variations and modifications can be effected within the spirit and scope of the invention.

What is claimed is:

1. A reaction vessel for confined amplification and detection of nucleic acid material, comprising:

a plurality of adjacent chambers, each chamber comprising a front wall, a back wall, two side walls, and a bottom wall, said front and back walls terminating in an upper opening at a top edge of said front and back walls, a side wall of each chamber comprising a side wall in common with an adjacent chamber so as to integrally connect said chambers side-by-side;

said front wall of each chamber including a liquid access port spanning all of said chambers below said top edge, said common side walls terminating at said port; and a movable elastomeric plug mounted within said upper opening above said port, shaped to block said port of each of said chambers and to stopper each said chamber when moved below said top edge, said plug spanning across all of said chambers in said vessel so as to close off said port simultaneously for all of said chambers when moved below said top edge.

2. A vessel as defined in claim 1, wherein each said chamber includes a bottom portion opposite said upper opening, said bottom portions having a dimension between said front and back walls that is narrower than the corresponding dimension adjacent said top edges.

3. A vessel as defined in claim 2, wherein said bottom portion is connected to said liquid access port by a shoulder in said front wall, said shoulder being effective to seal against said plug when said plug is moved to close off said port.

* * * * *